US011059300B2

(12) United States Patent
Kumamoto et al.

(10) Patent No.: US 11,059,300 B2
(45) Date of Patent: Jul. 13, 2021

(54) LIQUID SUPPLY APPARATUS

(71) Applicant: SEIKO EPSON CORPORATION, Tokyo (JP)

(72) Inventors: Kohei Kumamoto, Shiojiri (JP); Yasuhiko Kosugi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/831,529

(22) Filed: Mar. 26, 2020

(65) Prior Publication Data

US 2020/0307240 A1 Oct. 1, 2020

(30) Foreign Application Priority Data

Mar. 27, 2019 (JP) ..... JP2019-060453

(51) Int. Cl.
*B41J 2/175* (2006.01)

(52) U.S. Cl.
CPC ..... *B41J 2/17566* (2013.01); *B41J 2/17526* (2013.01)

(58) Field of Classification Search
CPC .... B41J 2/175; B41J 2/17509; B41J 2/17513; B41J 2/17523; B41J 2/17526; B41J 2/17546; B41J 2/17553; B41J 2/17566; B41J 29/13; B41J 2002/17516; B41J 2002/17573
See application file for complete search history.

(56) References Cited

U.S. PATENT DOCUMENTS 6,019,461 A * 2/2000 Yoshimura ..... B41J 2/17546 347/19
6,827,412 B2 * 12/2004 Inui ..... B41J 2/195 347/14
2005/0110823 A1 * 5/2005 Kobayashi ..... B41J 2/17503 347/19
2007/0103497 A1 * 5/2007 Takamura ..... B41J 2/04543 347/12
2008/0225064 A1 9/2008 Udagawa

FOREIGN PATENT DOCUMENTS

JP 2008-221576 A 9/2008

* cited by examiner

*Primary Examiner* — Anh T Vo
(74) *Attorney, Agent, or Firm* — Oliff PLC

(57) ABSTRACT

A liquid supply apparatus includes a liquid storage container including a memory, a liquid feeding mechanism that feeds out liquid to the print head, and a second controller. A first liquid consumption amount is a consumption amount of liquid consumed in a non-printing operation in which liquid is not discharged from the print head to a recording medium, and a second liquid consumption amount is a consumption amount of liquid consumed in a printing operation in which liquid is discharged from the print head to the recording medium. The second controller calculates the second liquid consumption amount based on a liquid feeding amount of liquid fed out from the liquid feeding mechanism in a printing operation, stores the second liquid consumption amount in the memory, receives the first liquid consumption amount from the first controller, and stores the first liquid consumption amount in the memory.

7 Claims, 7 Drawing Sheets

LIQUID SUPPLY APPARATUS

The present application is based on, and claims priority from JP Application Serial Number 2019-060453, filed Mar. 27, 2019, the disclosure of which is hereby incorporated by reference herein in its entirety.

BACKGROUND

1. Technical Field

The present disclosure relates to a liquid supply apparatus to be attached to a printing apparatus.

2. Related Art

Conventionally, as a technique for detecting a consumption amount of ink in an ink jet recording apparatus, there is a technique described in JP-A-2008-221576. In the technique of JP-A-2008-221576, four ink tank units that respectively store different color inks, an ink distribution unit, and a printing apparatus are coupled by a tube that supplies ink. The printing apparatus includes six print units, each of which discharges four color inks. Each ink tank unit includes a non-volatile memory.

When expanding print data, each print unit of the printing apparatus counts the number of times of discharges from each ink discharge port, which are required to perform recording based on the print data. Then, each print unit transmits an obtained dot count value to the ink distribution unit through a serial communication interface. The ink distribution unit calculates a cumulative value of the dot count value calculated for each ink color of each print unit and writes the cumulative value into the non-volatile memory of the ink tank unit.

In the technique of JP-A-2008-221576, the six print units independently calculate dot count values for four color inks and transmit the dot count values to the ink distribution unit through a serial communication interface. Therefore, until a dot count value of a certain ink color of a certain print unit is transmitted to the ink distribution unit and the dot count value is reflected to a cumulative value stored in the non-volatile memory of the ink tank unit, transmission of a dot count value of the same ink color of another print unit and reflection of the dot count value to the cumulative value should be waited. Therefore, there is a case where a printing speed of the printing apparatus is limited.

SUMMARY

According to one form of the present disclosure, a liquid supply apparatus that can be attached to and detached from a printing apparatus including a first controller that calculates a first liquid consumption amount and a print head that discharges liquid is provided. The liquid supply apparatus includes a liquid storage container that stores the liquid and includes a memory that stores a consumption amount of the stored liquid, a liquid feeding mechanism that feeds out the liquid stored in the liquid storage container to the print head, and a second controller that calculates a second liquid consumption amount. The first liquid consumption amount is a consumption amount of the liquid consumed in a non-printing operation in which the liquid is not discharged from the print head to a recording medium, and the second liquid consumption amount is a consumption amount of the liquid consumed in a printing operation in which the liquid is discharged from the print head to the recording medium. The second controller calculates the second liquid consumption amount based on a liquid feeding amount of the liquid fed out from the liquid feeding mechanism in the printing operation, stores the second liquid consumption amount in the memory, receives the first liquid consumption amount from the first controller, and stores the first liquid consumption amount in the memory.

DESCRIPTION OF EXEMPLARY EMBODIMENTS

Figure 1:
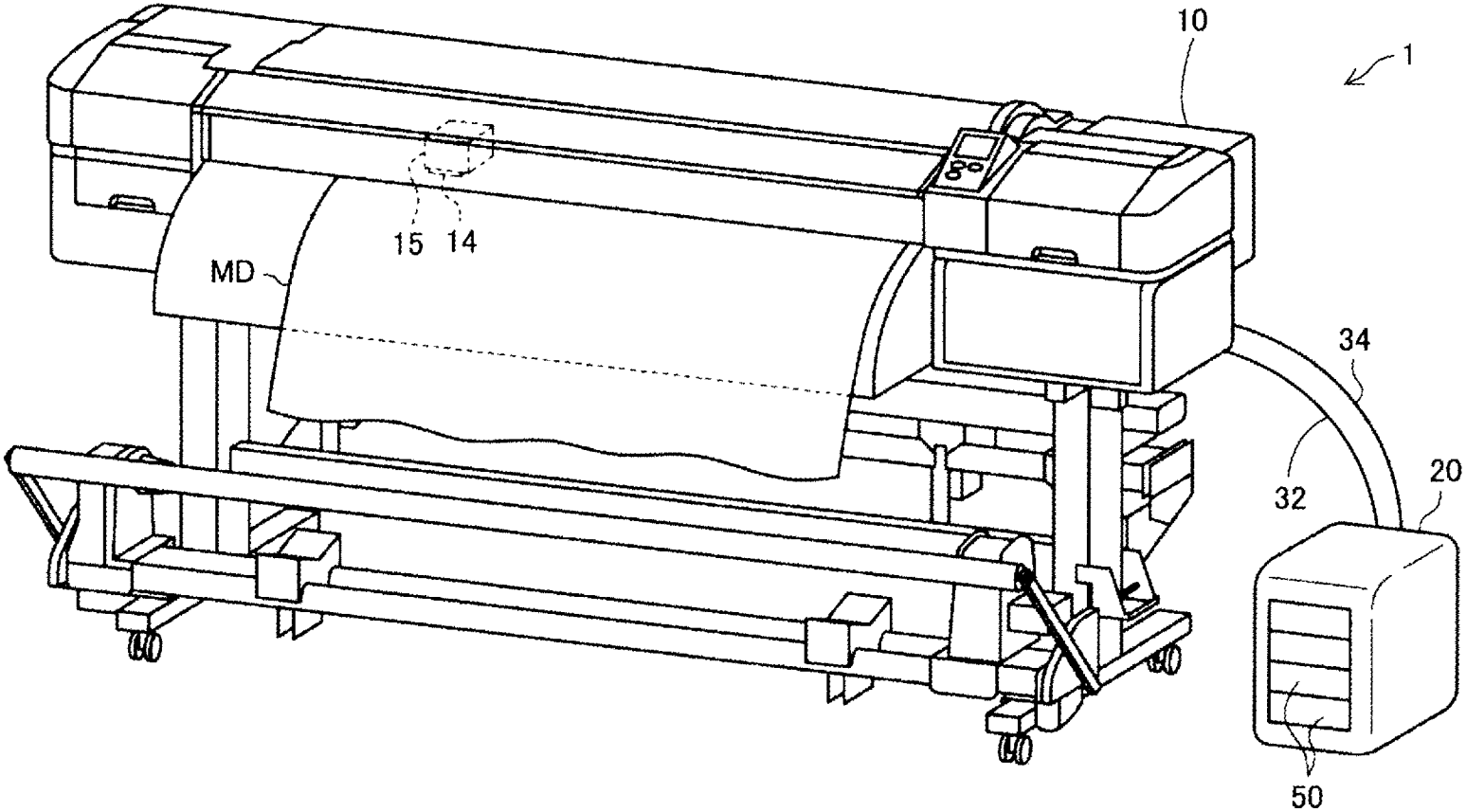
FIG. 1 is a perspective view showing a printing system of an embodiment.

A. First Embodiment:

A1. Configuration of Printing System:

FIG. 1 is a perspective view showing a printing system 1 of the present embodiment. The printing system 1 includes a printing apparatus 10 and a liquid supply apparatus 20.

The printing apparatus 10 is an apparatus that discharges ink, which is a liquid, to a recording medium MD and forms an image on the recording medium MD. The printing apparatus 10 is specifically an ink jet printer. The printing apparatus 10 includes a first controller 12, a print head 14, a carriage 15, a drive mechanism 16, a discharge sensor 17, and a communication interface 19. To easily understand a technique, the first controller 12, the discharge sensor 17, and the communication interface 19 are not shown in FIG. 1.

The print head 14 discharges ink. The print head 14 includes a plurality of nozzles. Ink is supplied to the print head 14 from the liquid supply apparatus 20 through an ink supply pipe 32, and ink droplets are discharged from each nozzle. An image is formed on the recording medium MD by a printing operation in which ink is discharged from the print head 14 to the recording medium MD.

The print head 14 discharges ink in a non-printing operation in which ink is not discharged from the print head 14 to the recording medium MD. The non-printing operation includes The non-printing operation includes (i) Initial filling that fills the printing apparatus 10 with ink, (ii) Cleaning for solving a discharge failure of the print head 14, (iii) Inspection for detecting a discharge failure of the print head 14, and (iv) Ink discharge performed for discharging thickened ink from nozzles when a predetermined period of time elapses after previous printing is completed. These operations will be further described later.

The carriage 15 is mounted with the print head 14. The carriage 15 is reciprocated along one direction by the drive mechanism 16. As a result, the print head 14 can discharge ink droplets to various positions in the direction.

Figure 2:
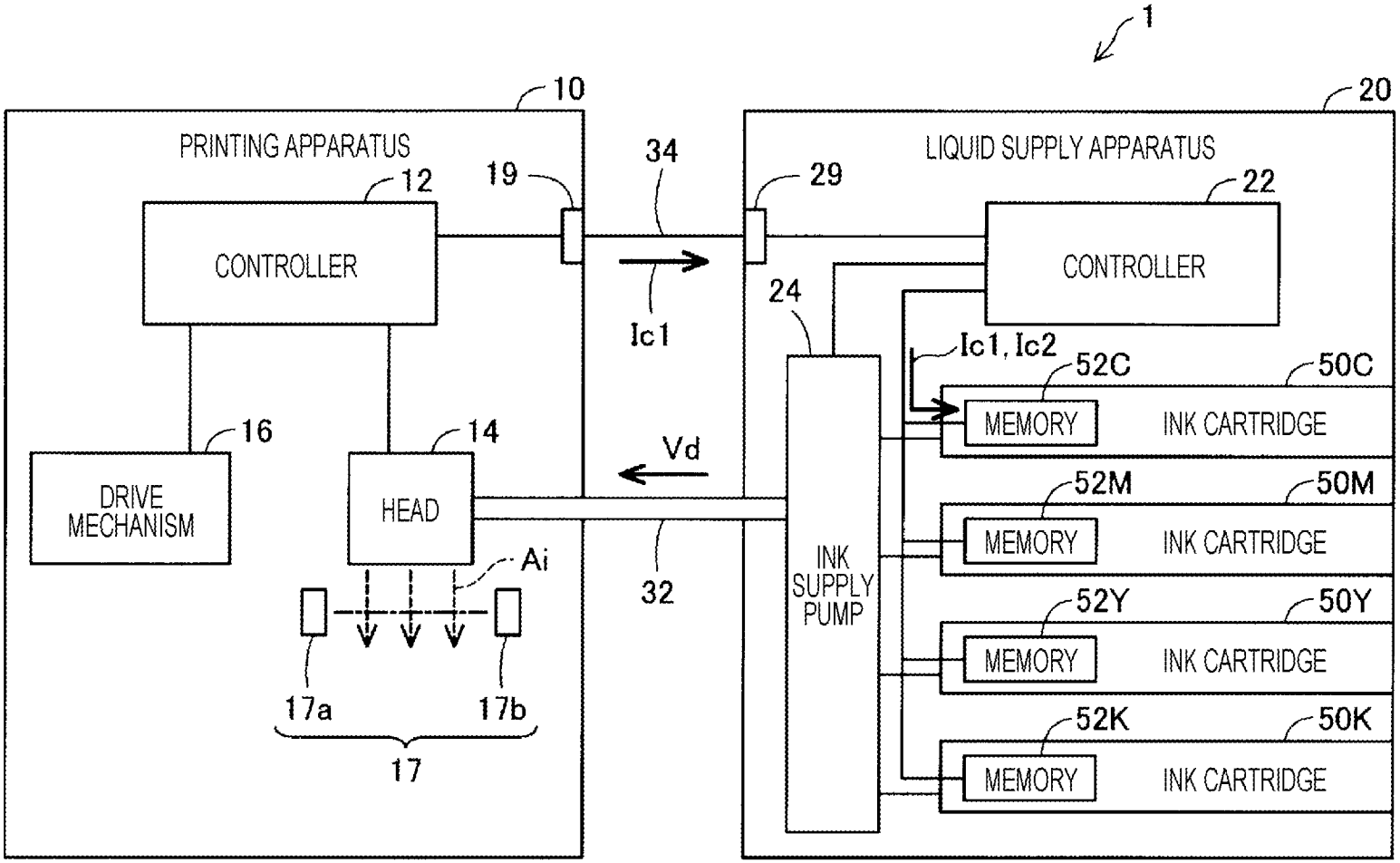
FIG. 2 is a block diagram showing a printing system of a first embodiment.

FIG. 2 is a block diagram showing the printing system 1 of the first embodiment. The drive mechanism 16 of the printing apparatus 10 reciprocates the carriage 15. The drive mechanism 16 moves the recording medium MD (see central part of FIG. 1) in a direction perpendicular to the direction of the reciprocation of the carriage 15 with respect to the carriage 15. As a result, the print head 14 mounted on the carriage 15 can discharge ink droplets in various positions on the recording medium MD. Specifically, the drive mechanism 16 is composed of a motor, a belt, a gear, a shaft, and the like.

The discharge sensor 17 is arranged at a position located below the print head 14 when the carriage 15 is located at one end in a moving range of the reciprocation. The discharge sensor 17 includes a light emitting portion 17*a* and a light receiving portion 17*b*. When the print head 14 does not discharge ink, light emitted from the light emitting portion 17*a* is received by the light receiving portion 17*b*. When the print head 14 discharges ink, at least part of light emitted from the light emitting portion 17*a* is blocked by ink droplets. As a result, the amount of light received by the receiving portion 17*b* decreases. Therefore, it is considered that there is a discharge failure of ink droplets when the amount of light received by the receiving portion 17*b* does not lower below a threshold value even though a drive signal is transmitted to the print head 14. In this case, the discharge sensor 17 outputs a signal indicating that there is a discharge failure.

The first controller 12 controls each part of the printing apparatus 10 including the print head 14, the carriage 15, the drive mechanism 16, and the discharge sensor 17. Specifically, the first controller 12 includes a CPU (Central Processing Unit) that is a processor, a RAM (Random Access Memory), and a ROM (Read-Only Memory). A control program for controlling the printing apparatus 10 is installed in the first controller 12. In the first controller 12, the CPU, the RAM, the ROM, and the control program cooperate together as hardware resources. Specifically, the CPU loads a computer program stored in the ROM into the RAM and executes the computer program, so that various functions are realized. For example, the first controller 12 calculates a liquid consumption amount Ic1 consumed in a non-printing operation. The first controller 12 transmits and receives information to and from the outside of the printing apparatus 10 through the communication interface 19.

The liquid supply apparatus 20 is an apparatus that supplies ink to the printing apparatus 10 (see FIG. 1). The liquid supply apparatus 20 can be attached to and detached from the printing apparatus 10. The liquid supply apparatus 20 includes a second controller 22, a liquid feeding mechanism 24, a communication interface 29, and liquid storage containers 50 (see FIG. 2).

As the liquid storage containers 50, a liquid storage container 50C that stores cyan ink, a liquid storage container 50M that stores magenta ink, a liquid storage container 50Y that stores yellow ink, and a liquid storage container 50K that stores black ink are exchangeably mounted in the liquid supply apparatus 20. In the present specification, when the liquid storage container(s) is referred to without distinguishing each ink, the liquid storage container(s) is written as the liquid storage container(s) 50. Here, the liquid storage container(s) 50 is also called an "ink cartridge(s) 50."

The liquid storage container 50 stores ink to be supplied to the printing apparatus 10. When the liquid storage container 50 becomes unable to supply ink to the printing apparatus 10, the liquid storage container 50 is replaced. The liquid storage container 50 includes a memory 52. The memory 52 stores a consumption amount of ink stored in the liquid storage container 50. In the present specification, when the memory is referred to when distinguishing each ink, the memory 52 is written as a memory 52C, a memory 52M, a memory 52Y, or a memory 52K.

The liquid feeding mechanism 24 is a mechanism that feeds out ink stored in the liquid storage container 50 to the print head 14. In the present specification, the liquid feeding mechanism 24 is specifically a diaphragm pump. In the present specification, the liquid feeding mechanism 24 is also called an "ink supply pump 24" (see lower central part of FIG. 2).

A pump is employed as the liquid feeding mechanism 24, so that it is possible to accurately control the amount of liquid fed out from the liquid feeding mechanism 24 to the print head 14 of the printing apparatus 10. As a result, it is possible to accurately calculate a liquid consumption amount Ic2 in the printing operation based on a liquid feeding amount fed out from the liquid feeding mechanism 24. A calculation method of the liquid consumption amount Ic2 in the printing operation will be described later.

The second controller 22 controls each part of the liquid supply apparatus 20 including the liquid feeding mechanism 24. Specifically, the second controller 22 includes a CPU that is a processor, a RAM, and a ROM. A control program for controlling the liquid feeding mechanism 24 is installed in the second controller 22. In the second controller 22, the CPU, the RAM, the ROM, and the control program cooperate together as hardware resources. Specifically, the CPU loads a computer program stored in the ROM into the RAM and executes the computer program, so that various functions are realized. For example, the second controller 22 calculates the liquid consumption amount Ic2 consumed in a printing operation and stores the liquid consumption amount Ic2 into the memory 52. The second controller 22 transmits and receives information to and from the outside of the liquid supply apparatus 20 through the communication interface 29.

Figure 3:
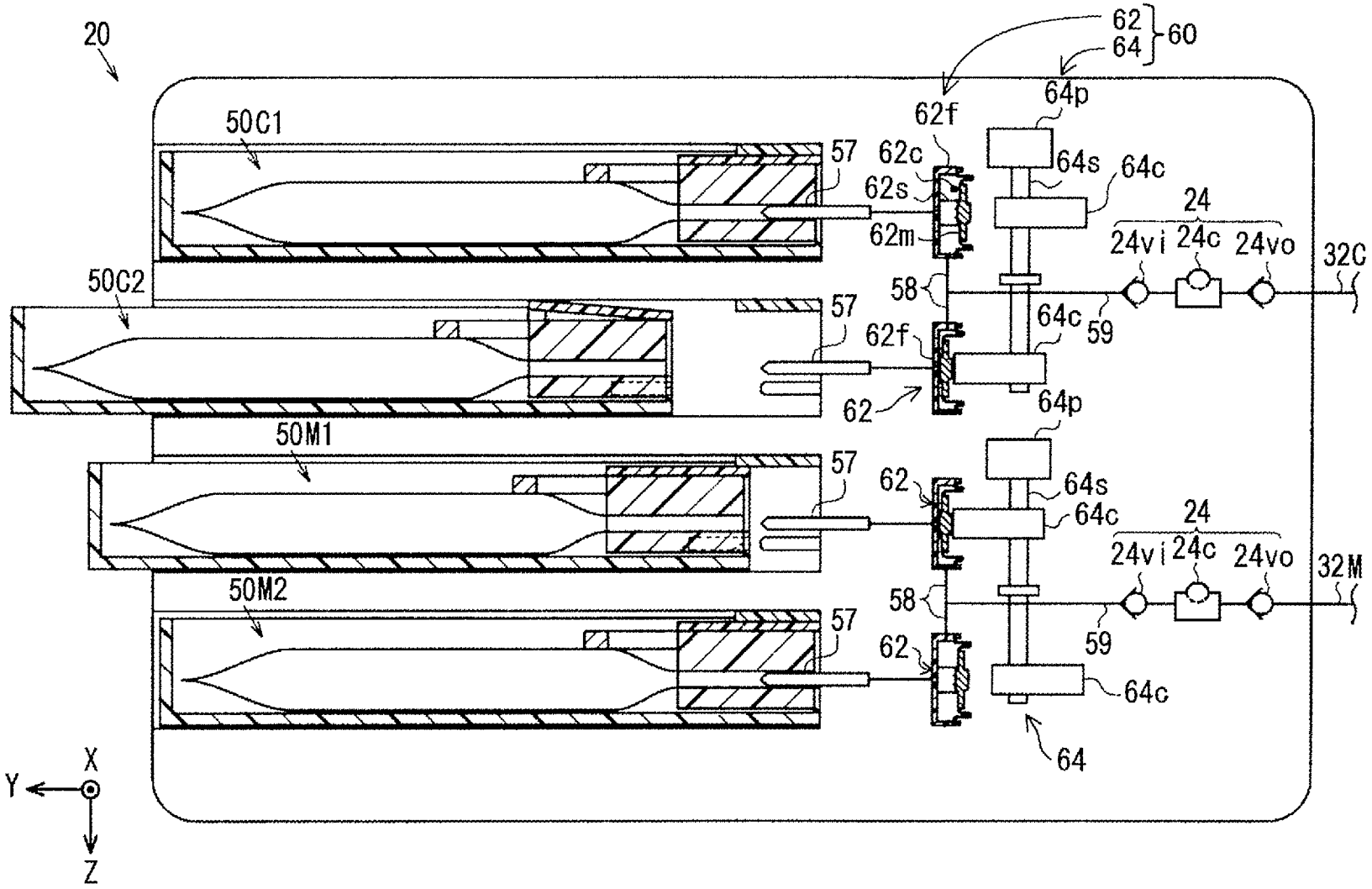
FIG. 3 is an explanatory diagram showing a detailed configuration of a liquid supply apparatus.

FIG. 3 is an explanatory diagram showing a detailed configuration of the liquid supply apparatus 20. Two liquid storage containers 50 for one color ink can be attached to the liquid supply apparatus 20. To easily understand a technique, FIG. 3 shows only liquid storage containers 50C1 and 50C2 that store cyan ink and liquid storage containers 50M1 and 50M2 that store magenta ink. In the present specification, when the liquid storage container(s) is referred to without distinguishing the liquid storage containers 50C1, 50C2, 50M1, and 50M2, the liquid storage container(s) is written as the liquid storage container(s) 50.

Hereinafter, the liquid supply apparatus 20 will be described focusing on a mechanism that supplies cyan ink to the outside (see upper part of FIG. 3). In the liquid supply apparatus 20, a mechanism that supplies ink of another color to the outside has the same configuration and functions in the same manner (see lower part of FIG. 3).

The liquid supply apparatus 20 has two insertion portions 57, two individual flow paths 58, and one converging flow path 59, as flow paths of cyan ink. The two insertion portions 57, the two individual flow paths 58, and the one converging flow path 59 are located closer to the liquid storage containers 50C1 and 50C2 in this order and connected to each other in this order. The insertion portions 57 are coupled to the liquid storage containers 50C1 and 50C2, respectively. The converging flow path 59 is coupled to an ink supply pipe 32C. The liquid supply apparatus 20 further includes a valve mechanism 60 and the liquid feeding mechanism 24.

The insertion portion 57 is inserted into the liquid storage container 50 and discharges ink in the liquid storage container 50 to the outside.

The individual flow path 58 receives ink from the insertion portion 57. The individual flow paths 58 are provided with the valve mechanism 60. The valve mechanism 60 includes valve main bodies 62 and a drive unit 64. One valve main body 62 is provided for each liquid storage container 50. One drive unit 64 is provided for every two valve main bodies 62.

The valve main body 62 includes a fixed wall 62*f*, a movable wall 62*m*, and a coil spring 62*s*. The fixed wall 62*f* and the movable wall 62*m* define a space 62*c* that stores ink. The space 62*c* communicates with the insertion portion 57 and the individual flow path 58. The movable wall 62*m* is configured to be able to move with respect to the fixed wall 62*f*. The coil spring 62*s* keeps a distance between the fixed wall 62*f* and the movable wall 62*m* constant in a state in which no external force is applied to the movable wall 62*m*. In this state, the insertion portion 57 and the individual flow path 58 communicate with each other through the space 62*c* (see upper right part of FIG. 3). This state is a valve open state of the valve main body 62.

On the other hand, when an external force is applied to the movable wall 62*m* in a direction to compress the coil spring 62*s*, the movable wall 62*m* comes into contact with the fixed wall 62*f* and closes an opening of the insertion portion 57 provided to the fixed wall 62*f*. As a result, the communication between the insertion portion 57 and the individual flow path 58 is sealed (see middle right part of FIG. 3). This state is a valve closed state of the valve main body 62.

The drive unit 64 includes a drive source 64*p*, a rotation shaft 64*s*, and two cams 64*c* and 64*c*. The drive source 64*p* rotates the rotation shaft 64*s*. The cams 64*c* and 64*c* are eccentrically attached to the rotation shaft 64*s* in phases different from each other by 180°. When the drive unit 64 rotates the rotation shaft 64*s*, one of the two cams 64*c* and 64*c* pushes a corresponding movable wall 62*m* of the valve main body 62 and closes the valve main body 62 (see middle right part of FIG. 3). At this time, the other cam 64*c* is away from a corresponding movable wall 62*m* of the valve main body 62 and opens the valve main body 62 (see upper right part of FIG. 3).

In this way, the valve mechanism 60 causes one of the two liquid storage containers 50C1 and 50C2 that store the same ink to selectively communicate with the converging flow path 59, that is, eventually the ink supply pipe 32C.

The converging flow path 59 is coupled to two individual flow paths 58 through which the same ink flows (see crossing right part of FIG. 3). However, as described above, the individual flow path 58 that supplies ink to the converging flow path 59 is limited to one of the two individual flow paths 58 by the valve mechanism 60. The converging flow path 59 is provided with the liquid feeding mechanism 24.

The liquid feeding mechanism 24 includes a liquid chamber portion 24*c*, an inlet valve 24*vi*, and an outlet valve 24*vo*. The liquid chamber portion 24*c* includes a diaphragm as one wall surface. The volume of the liquid chamber portion 24*c* is changed by deformation of the diaphragm. The amount of change of the volume of the liquid chamber portion 24*c* by the deformation of the diaphragm is a constant value.

The inlet valve 24*vi* is provided on the upstream side, that is, on the individual flow path 58 side, of the liquid chamber portion 24*c*. The inlet valve 24*vi* allows ink to flow in a direction from upstream to downstream, that is, a direction from the individual flow path 58 to the ink supply pipe 32C. The inlet valve 24*vi* does not allow ink to flow in a direction from downstream to upstream, that is, a direction from the ink supply pipe 32C to the individual flow path 58.

The outlet valve 24*vo* is provided on the downstream side, that is, on the ink supply pipe 32C side, of the liquid chamber portion 24*c*. The outlet valve 24*vo* allows ink to flow in the direction from upstream to downstream, that is, the direction from the individual flow path 58 to the ink supply pipe 32C. The outlet valve 24*vo* does not allow ink to flow in the direction from downstream to upstream, that is, the direction from the ink supply pipe 32C to the individual flow path 58.

The liquid feeding mechanism 24 transfers ink in the direction from upstream to downstream, that is, the direction from the individual flow path 58 to the ink supply pipe 32C, by driving the diaphragm of the liquid chamber portion 24*c* and restricting the flow of ink through the inlet valve 24*vi* and the outlet valve 24*vo*. The liquid feeding mechanism 24 is controlled by the second controller 22. Therefore, the second controller 22 can measure a drive time of the liquid feeding mechanism 24 in a certain time period, more specifically, a drive time of the diaphragm of the liquid chamber portion 24*c*.

The printing apparatus 10 and the liquid supply apparatus 20 are coupled by the ink supply pipes 32 and an information communication cable 34 (see right part of FIG. 1 and central part of FIG. 2).

The ink supply pipe 32 is provided for each color of ink. In the present embodiment, the printing apparatus 10 and the liquid supply apparatus 20 are coupled by the ink supply pipe 32C through which cyan ink flows, an ink supply pipe 32M through which magenta ink flows, an ink supply pipe 32Y through which yellow ink flows, and an ink supply pipe 32K through which black ink flows. In the present specification, when the ink supply pipe(s) is referred to without distinguishing each ink, the ink supply pipe(s) is written as the ink supply pipe(s) 32. To easily understand a technique, FIG. 1 shows one ink supply pipe 32.

The information communication cable 34 is a cable for the first controller 12 of the printing apparatus 10 and the second controller 22 of the liquid supply apparatus 20 to communicate with each other (see central part of FIG. 2). Specifically, the information communication cable 34 is a USB (Universal Serial Bus) cable. The communication interface 19 of the printing apparatus 10 and the communication interface 29 of the liquid supply apparatus 20 are USB ports. As a result, the liquid supply apparatus 20 is USB-coupled to the printing apparatus 10.

By using such a configuration, the liquid supply apparatus 20 can be connected to various types of printing apparatus 10.

A2. Operation of Printing System

The printing apparatus 10 performs various processing under control of the first controller 12 (see FIG. 2). Hereinafter, measurement and storage of the ink consumption amount will be described for each of the non-printing operation and the printing operation.

(1) Non-Printing Operation:

The printing apparatus 10 performs the non-printing operation, in which ink is discharged from the print head 14, in addition to the printing operation. In the non-printing operation, ink is not discharged to the recording medium MD. The non-printing operation includes the operations (i) to (iv) described below.

(i) Initial Filling that Fills the Printing Apparatus with Ink:

When the liquid storage container 50 filled with ink is attached to the liquid supply apparatus 20, the ink does not yet exist in the insertion portion 57, the individual flow path 58, the converging flow path 59, the ink supply pipe 32, and the print head 14 (see upper right part of FIG. 3). Therefore, before the printing operation, the ink stored in the liquid storage container 50 is fed up to the nozzles of the print head 14 from the liquid storage container 50 through the insertion portion 57, the individual flow path 58, the converging flow path 59, the ink supply pipe 32. Then, the ink is discharged from the nozzles of the print head 14. Thereafter, the printing operation becomes executable. In the initial filling, the ink is consumed.

(ii) Cleaning for Solving a Discharge Failure of the Print Head:

When an inspection by the discharge sensor 17 (refer to (iii) below) finds that the ink is not discharged from the nozzle(s) of the print head 14, a cap is put on a surface where the nozzles of the print head 14 are provided, a suction pump provided in the printing apparatus 10 is operated, and inside air is sucked. As a result, pressure in the cap becomes lower than environmental pressure, so that the ink flows out from the nozzles of the print head 14 to a space inside the cap. As a result, nozzle clogging is eliminated. The ink is consumed by the cleaning operation.

(iii) Inspection for Detecting a Discharge Failure of the Print Head:

In the inspection for detecting a discharge failure of the print head 14, the print head 14 is arranged above the discharge sensor 17 and discharges ink droplets from the nozzles (see lower left part of FIG. 2). When the amount of light that is emitted from the light emitting portion 17*a* and received by the receiving portion 17*b* does not lower below a threshold value, the discharge sensor 17 outputs a signal indicating that there is a discharge failure of the ink droplets. The ink is consumed by the discharge inspection.

(iv) Ink Discharge Performed when a Certain Period of Time Elapses after Printing is Completed:

When a predetermined period of time elapses after previous printing is completed, ink is discharged from the nozzles of the print head 14. This operation is called "flushing". Ink which is close to nozzles and whose viscosity is increased due to volatilization of solvent contained in the ink is discharged from the nozzles as a result of the flushing. By this processing, the viscosity of the ink used for printing is maintained within a constant range, and the quality of printing result is maintained. The ink is consumed by the flushing.

In each operation described above, the first controller 12 of the printing apparatus 10 calculates the liquid consumption amount Ic1 in the non-printing operation, which is a liquid consumption amount consumed in each operation described above, based on a signal to the print head 14, a signal to the suction pump provided in the printing apparatus 10, and the like.

In each operation described above, different from a printing operation performed by discharging ink droplets, the ink is continuously consumed. Therefore, it is difficult to accurately calculate a consumption amount of liquid in the liquid supply apparatus 20 (see right part of FIG. 2) that supplies ink to the printing apparatus 10. However, in the present embodiment, in the operations described above, the liquid consumption amount consumed in a non-printing operation is calculated by the first controller 12 provided in the printing apparatus 10 (see left part of FIG. 2) where the operations are performed. Therefore, it is possible to highly accurately calculate the liquid consumption amount Ic1.

Thereafter, the first controller 12 of the printing apparatus 10 transmits information of the liquid consumption amount Ic1 in the non-printing operation to the second controller 22 of the liquid supply apparatus 20 (see upper central part of FIG. 2).

The second controller 22 of the liquid supply apparatus 20 receives the liquid consumption amount Ic1 in the non-printing operation from the first controller 12 of the printing apparatus 10. More specifically, the second controller 22 of the liquid supply apparatus 20 receives the liquid consumption amount Ic1 transmitted from the printing apparatus 10 through the information communication cable 34 that is a USB cable coupled to the communication interface 29 that is a USB port. Then, the second controller 22 of the liquid supply apparatus 20 stores the liquid consumption amount Ic1 in the non-printing operation into the memory 52 of the liquid storage container 50 (see upper right part of FIG. 2).

By performing such processing, even when one liquid storage container 50 is removed from the liquid supply apparatus 20 and another liquid storage container 50 is attached to the liquid supply apparatus 20, the ink consumption amount or the ink remaining amount of each liquid storage container 50 is appropriately maintained.

(2) Printing Operation:

In the printing operation, the carriage 15 is reciprocated along one direction by the drive mechanism 16 and the recording medium MD is transported in a direction perpendicular to the direction of the reciprocation of the carriage 15 with respect to the carriage 15. Meanwhile, ink droplets are discharged from the print head 14 mounted on the carriage 15 to the recording medium MD and an image is formed on the recording medium MD.

The second controller 22 of the liquid supply apparatus 20 calculates the liquid consumption amount Ic2 in the printing operation based on a liquid feeding amount Vd (see central part of FIG. 2) of the ink fed out from the liquid feeding mechanism 24 in the printing operation. Specifically, the second controller 22 of the liquid supply apparatus 20 measures time required for the liquid feeding mechanism 24 to feed out ink to the print head 14 of the printing apparatus 10 in the printing operation described above. The time required for the liquid feeding mechanism 24 to feed out ink to the print head 14 of the printing apparatus 10 can be calculated based on, for example, information of signals for driving each part of the printing apparatus 10, which are transmitted from the first controller 12 of the printing apparatus 10 to the second controller 22 of the liquid supply apparatus 20.

Then, the second controller 22 of the liquid supply apparatus 20 calculates the liquid consumption amount Ic2 in the printing operation based on the liquid feeding amount Vd obtained by multiplying a flow rate per unit time of the liquid fed out from the liquid feeding mechanism 24 to the print head 14 by the measured time. The flow rate per unit time of the liquid fed out from the liquid feeding mechanism 24 to the print head 14 is defined when the liquid supply apparatus 20 is designed. The flow rate per unit time of the liquid fed out from the liquid feeding mechanism 24 to the print head 14 is stored in the ROM of the second controller 22 in advance.

By performing such processing when calculating the liquid consumption amount Ic2 in the printing operation, it is possible to accurately calculate the liquid consumption amount Ic2 in the printing operation.

Thereafter, the second controller 22 of the liquid supply apparatus 20 stores the liquid consumption amount Ic2 in the printing operation into the memory 52 of the liquid storage container 50 that supplies the ink (see right part of FIG. 3 and right part of FIG. 2).

By performing such processing, even when one liquid storage container 50 is removed from the liquid supply apparatus 20 and another liquid storage container 50 is attached to the liquid supply apparatus 20, the ink consumption amount or the ink remaining amount of each liquid storage container 50 is appropriately maintained.

The processing described above is performed for each color of ink stored in the liquid storage containers 50 mounted in the liquid supply apparatus 20 (see 50C, 50M, 50Y, and 50K in FIG. 2).

In the present embodiment, information related to the liquid consumption amount Ic2 in the printing operation is calculated by the liquid supply apparatus 20 and stored in the memory 52 (upper right part of FIG. 2) without being transmitted from the printing apparatus 10 to the liquid supply apparatus 20. Therefore, the communication frequency between the printing apparatus 10 and the liquid supply apparatus 20 can be reduced as compared with a case in which all types of liquid consumption amounts are calculated in the printing apparatus 10 and transmitted from the printing apparatus 10 to the liquid supply apparatus 20. As a result, it is possible to reduce the possibility that a printing speed of the printing apparatus 10 is limited by communication between the printing apparatus 10 and the liquid supply apparatus 20.

The liquid consumption amount Ic1 consumed in the non-printing operation in the present embodiment is also called a "first liquid consumption amount". The liquid consumption amount consumed in the printing operation is also called a "second liquid consumption amount".

Figure 4:
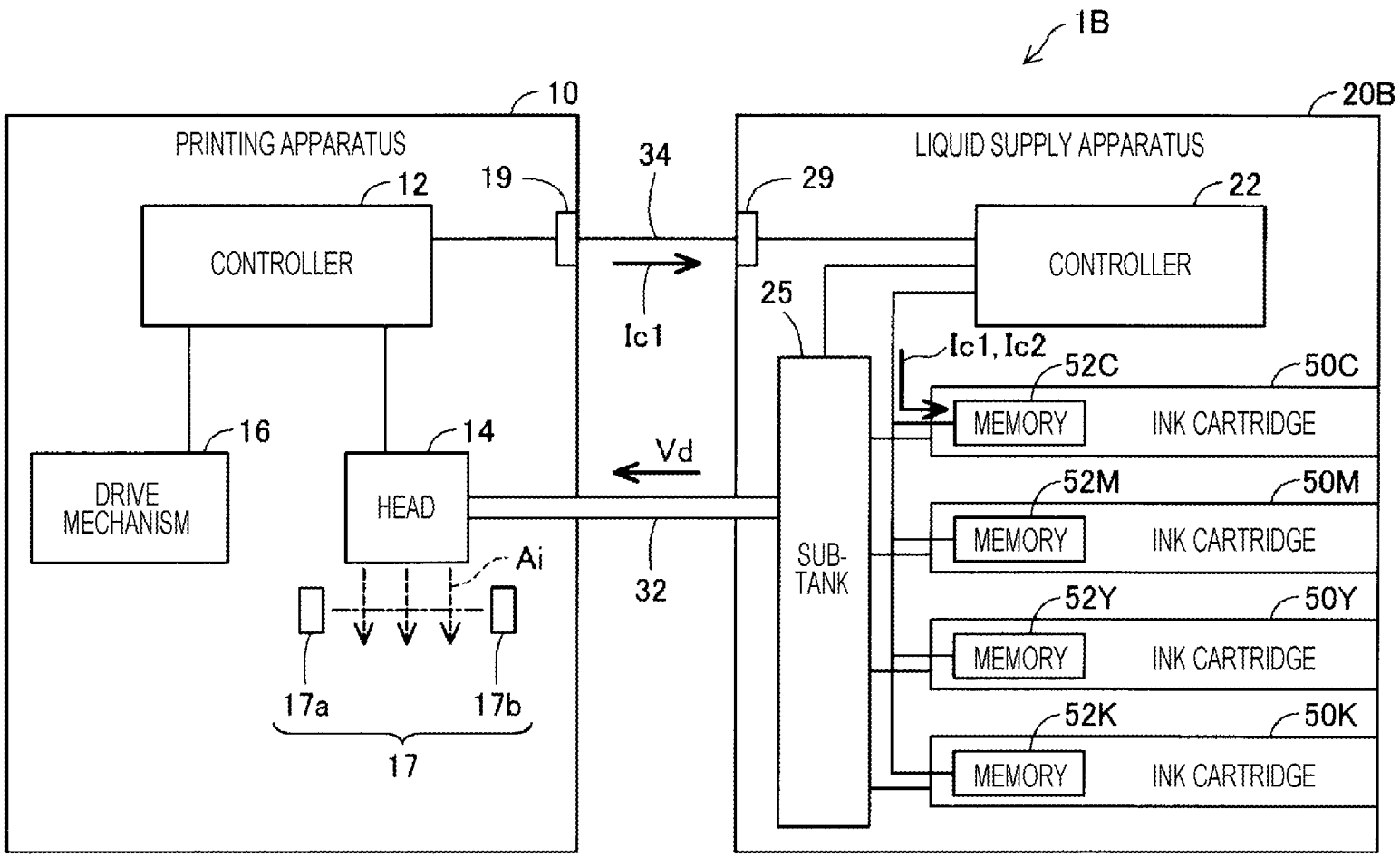
FIG. 4 is a block diagram showing a printing system of a second embodiment.

B. Second Embodiment:

FIG. 4 is a block diagram showing a printing system 1B of a second embodiment. The printing system 1B of the second embodiment includes a liquid feeding mechanism 25 instead of the liquid feeding mechanism 24 of the printing system 1 of the first embodiment. In the present embodiment, the liquid feeding mechanism 25 is also called a "sub-tank 25" (see lower central part of FIG. 2 and lower central part of FIG. 4). In the printing system 1B of the second embodiment, the calculation method of the liquid consumption amount Ic2 in the printing operation in the second controller 22 of the liquid supply apparatus 20 is different from that of the first embodiment. The other points of the printing system of the second embodiment are the same as those of the printing system 1 of the first embodiment.

Figure 5:
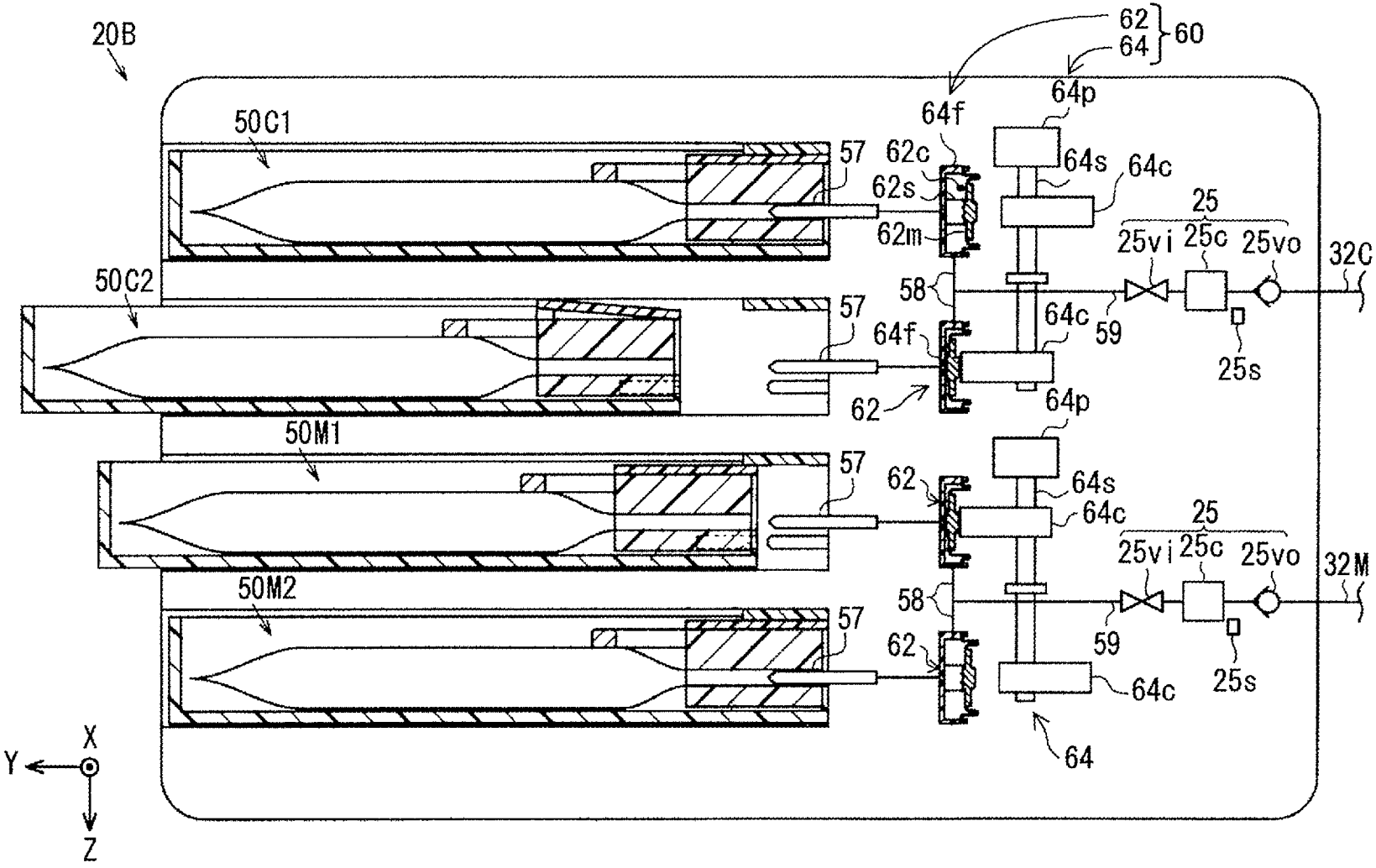
FIG. 5 is an explanatory diagram showing a detailed configuration of a liquid supply apparatus in the printing system of the second embodiment.

FIG. 5 is an explanatory diagram showing a detailed configuration of a liquid supply apparatus 20B in the printing system 1B of the second embodiment. The liquid supply apparatus 20B is arranged so that a Y axis positive direction shown in FIG. 5 faces upward in a gravity direction. The liquid supply apparatus 20B supplies ink to the printing apparatus 10 by using gravity.

Hereinafter, the liquid supply apparatus 20B will be described focusing on a mechanism that supplies cyan ink to the outside (see upper part of FIG. 5). In the liquid supply apparatus 20B, a mechanism that supplies ink of another color to the outside has the same configuration and functions in the same manner (see lower part of FIG. 5).

The liquid supply apparatus 20B includes the liquid feeding mechanism 25 (see upper right part of FIG. 5). The liquid feeding mechanism 25 is a mechanism that feeds out ink stored in the liquid storage container 50 to the print head 14. The liquid feeding mechanism 25 includes a liquid storage container 25*c*, an on-off valve 25*vi*, an outlet valve 25*vo*, and a sensor 25*s*.

The liquid storage container 25*c* stores ink supplied from the liquid storage container 50 through the insertion portion 57, the individual flow path 58, and the converging flow path 59. The volume of the liquid storage container 25*c* is constant. The liquid storage container 25*c* has a prism 661 on a part of its bottom surface. The configuration and operation of the prism 661 will be described later.

The sensor 25*s* can detect the amount of ink stored in the liquid storage container 25*c*. The configuration and operation of the sensor 25*s* will be described later.

The on-off valve 25*vi* is provided on the upstream side, that is, on the individual flow path 58 side, of the liquid storage container 25*c*. The on-off valve 25*vi* is opened/closed by being controlled by the second controller 22 (see upper right part of FIG. 4) of the liquid supply apparatus 20B. When the amount of ink in the liquid storage container 25*c* becomes less than a lower limit threshold value LL, the second controller 22 opens the on-off valve 25*vi* and supplies ink into the liquid storage container 25*c* until the amount of ink in the liquid storage container 25*c* reaches an upper limit threshold value LF.

The outlet valve 25*vo* is provided on the downstream side, that is, on the ink supply pipe 32C side, of the liquid storage container 25*c*. The configuration and function of the outlet valve 25*vo* are the same as those of the outlet valve 24*vo* (see right part of FIG. 3).

The liquid feeding mechanism 25 transfers ink in the direction from upstream to downstream, that is, the direction from the individual flow path 58 to the ink supply pipe 32C, by using gravity while opening/closing the on-off valve 25*vi*. The liquid feeding mechanism 25 is controlled by the second controller 22.

Figure 6:
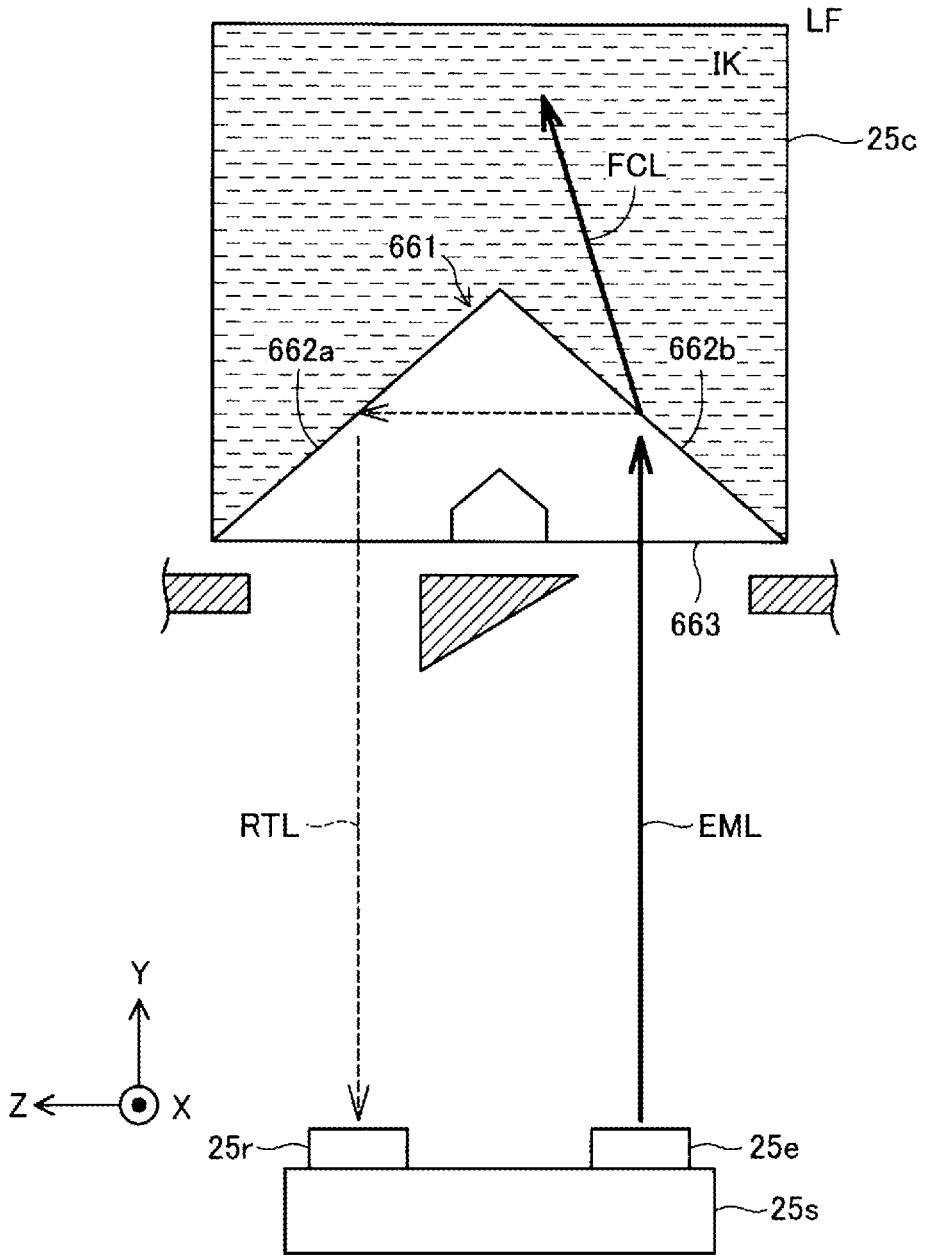
FIG. 6 is an explanatory diagram showing a principle in which ink stored in a liquid storage container is detected by using a sensor and a prism.

FIG. 6 is an explanatory diagram showing a principle in which ink stored in the liquid storage container 25*c* is detected by using the sensor 25*s* and the prism 661. The sensor 25*s* of the liquid feeding mechanism 25 includes a light emitting portion 25*e* and a light receiving portion 25*r*. The light emitting portion 25*e* emits light to the prism 661 provided in the liquid storage container 25*c*. The light emitting portion 25*e* is composed of an LED (Light Emission Diode). The light receiving portion 25*r* receives light reflected from the prism and converts the light into an electrical signal. The light receiving portion 25*r* is composed of a phototransistor. The sensor 25*s* outputs a signal according to the light received by the light receiving portion 25*r*.

The prism 661 is provided on a part of the bottom surface of the liquid storage container 25*c* (see FIG. 5). The prism 661 is a right angle prism having a triangular prism shape. The prism 661 has a first surface 662*a* and a second surface 662*b* facing each other and tilting at the same angle with respect to a horizontal surface. In the present embodiment, the angle at which each of the first surface 662*a* and the second surface 662*b* tilts with respect to the horizontal surface is 45 degrees. A surface 663 facing a Y axis negative direction of the prism 661 is also called an "incident surface 663".

When the inside of the liquid storage container 25*c* is filled with ink IK, light EML which is emitted in the Y axis positive direction from the light emitting portion 25*e* and enters the prism 661 enters into the ink IK from the second surface 662*b*. In FIG. 6, the light that enters into the ink IK is shown as refracted light FCL. As a result, light RTL that is reflected by the second surface 662*b* and the first surface

662*a* is very small. Therefore, the light receiving portion 25*r* hardly receives the reflected light RTL. As a result, the sensor 25*s* outputs a very weak signal.

Figure 7:
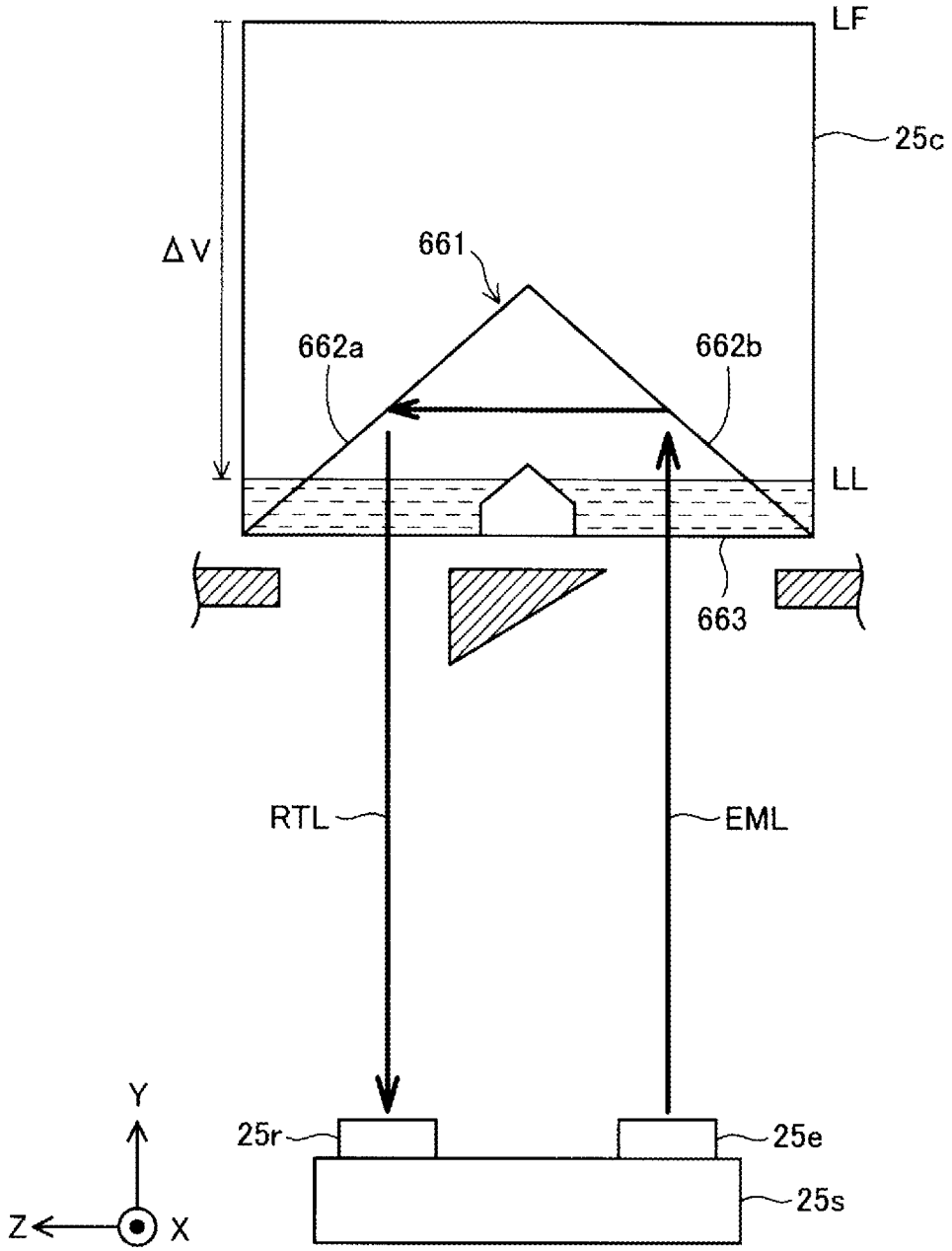
FIG. 7 is an explanatory diagram showing a principle in which it is detected that an ink remaining amount in the liquid storage container is less than a predetermined value by using the sensor and the prism.

FIG. 7 is an explanatory diagram showing a principle in which it is detected that an ink remaining amount in the liquid storage container 25*c* is less than a predetermined value by using the sensor 25*s* and the prism 661. The ink IK in the liquid storage container 25*c* is consumed for printing. As a result, in the first surface 662*a* and the second surface 662*b* of the prism 661, a portion which is irradiated with the light from the light emitting portion 25*e* comes into contact with air in the liquid storage container 25*c*. FIG. 7 shows a state as described above.

In this state, the incident light EML is totally reflected on the first surface 662*a* and the second surface 662*b*. The reflected light RTL is emitted from the incident surface 663 to the outside of the prism 661. The light receiving portion 25*r* receives the reflected light RTL. As a result, the sensor 25*s* outputs a stronger signal as compared with the case of FIG. 6.

The second controller 22 (see upper right part of FIG. 4) of the liquid supply apparatus 20 can detect that the amount of ink in the liquid storage container 25c becomes less than a predetermined amount LL by the signal from the sensor 25*s*. When the amount of ink in the liquid storage container 25*c* becomes less than the predetermined amount LL, the second controller 22 opens the on-off valve 25*vi* (see upper right part of FIG. 5) and fills the inside of the liquid storage container 25*c* with ink. The amount of ink when the inside of the liquid storage container 25*c* is filled with ink is indicated by LF in FIGS. 6 and 7. When the amount of ink in the liquid storage container 25*c* becomes less than the predetermined amount LL, it means that the ink is consumed by a volume ΔV (ΔV=LF−LL) from a state in which the liquid storage container 25*c* is filled with ink.

While the printing apparatus 10 performs a printing operation, the second controller 22 calculates the liquid consumption amount Ic2 in the printing operation based on the liquid feeding amount Vd obtained from a reduction amount ΔV of ink which is temporarily stored in the liquid storage container 25*c* by the liquid feeding mechanism 25. Here, ΔV is a sufficiently small value with respect to the consumption amount of ink of each color consumed in one printing operation. In other words, the second controller 22 opens the on-off valve 25*vi* (see upper right part of FIG. 5) a plurality of times in one printing operation.

By using such a configuration, the second controller 22 can accurately detect the amount of liquid fed out from the liquid feeding mechanism 25 to the print head 14 based on the output of the sensor 25*s*. As a result, it is possible to calculate the liquid consumption amount Ic2 in the printing operation based on the liquid feeding amount of the liquid fed out from the liquid feeding mechanism 25.

Also in the second embodiment, in the same manner as in the first embodiment, it is possible to reduce the communication frequency between the printing apparatus 10 and the liquid supply apparatus 20. As a result, it is possible to reduce the possibility that a printing speed of the printing apparatus 10 is limited by communication between the printing apparatus 10 and the liquid supply apparatus 20.

The liquid storage container 25*c* in the present embodiment is also called a "second liquid storage container" in order to show that the liquid storage container 25*c* is a liquid storage container different from the liquid storage container 50. In this case, the liquid storage container 50 is also called a "first liquid storage container".

C. Other Embodiments:

C1. Another Form 1:

(1) In the embodiment described above, the technique of the present disclosure is described by using the printing apparatus 10 that is an ink jet printer and the liquid supply apparatus 20 that is an apparatus for supplying ink to the printing apparatus 10 as an example. However, the technique of the present disclosure can be applied not only to printers that consume ink, but also to various liquid consumption apparatuses that consume liquid and liquid supply apparatuses that can be attached to and detached from the liquid consumption apparatuses. For example, the technique of the present disclosure can be applied to an apparatus that forms a pattern on a printed circuit board and a liquid supply apparatus that can be attached to and detached from the apparatus.

(1) In the embodiment described above, the prism 661 is a right angle prism (see FIGS. 6 and 7). However, the prism provided in the liquid storage container may be a prism having another form such as, for example, a triangular prism having a regular triangular cross section. However, it is preferable to use a prism having a first surface and a second surface facing each other and tilting at the same angle with respect to a horizontal surface.

C2. Another Form 2:

In the first embodiment described above, the liquid feeding amount Vd is calculated by multiplying the flow rate per unit time of the liquid fed out from the liquid feeding mechanism 24 to the print head 14 by the time required for the liquid feeding mechanism 24 to feed out ink to the print head 14 of the printing apparatus 10 in the printing operation. Then, the liquid consumption amount Ic2 in the printing operation is calculated based on the liquid feeding amount Vd. However, the liquid consumption amount Ic2 in the printing operation may be calculated based on an output of a flow rate sensor provided on a flow path of the liquid in the liquid supply apparatus 20.

C3. Another Form 3:

In the first embodiment described above, the liquid feeding mechanism 24 is a diaphragm pump (see right part of FIG. 3). However, the liquid feeding mechanism can employ various types of pumps other than the diaphragm pump. For example, the liquid feeding mechanism may be another reciprocating pump such as a plunger pump or a piston pump. Further, the liquid feeding mechanism may be a rotary pump such as a gear pump or a vane pump. However, it is preferable that the liquid feeding mechanism is a positive displacement pump.

C4. Another Form 4:

In the second embodiment described above, the second controller 22 calculates the liquid consumption amount Ic2 in the printing operation based on the liquid feeding amount Vd obtained from the reduction amount ΔV of ink which is temporarily stored in the liquid storage container 25*c* by the liquid feeding mechanism 25 (see FIG. 7). However, the liquid supply apparatus 20 may include a weight sensor that can measure weight of the liquid storage container 50, and the liquid consumption amount Ic2 in the printing operation may be calculated based on a reduction amount of the weight of the liquid storage container 50.

C5. Another Form 5:

In the second embodiment described above, the ink in the liquid storage container 25*c* is detected by using the sensor 25*s* and the prism 661 (see FIGS. 6 and 7). However, when a prism is provided on a bottom surface of the liquid chamber portion 24*c* in the diaphragm pump of the first embodiment, the ink in the liquid storage container 25*c* can be detected by using the prism and a sensor similar to the sensor 25*s* of the second embodiment.

C6. Another Form 6:

In the first embodiment described above, the non-printing operations where the first controller 12 calculates the liquid consumption amount Ic1 include the following operations: (i) Initial filling that fills the printing apparatus 10 with ink, (ii) Cleaning for solving a discharge failure of the print head 14, (iii) Inspection for detecting a discharge failure of the print head 14, and (iv) Ink discharge performed for discharging thickened ink from nozzles when a predetermined period of time elapses after previous printing is completed.

However, the non-printing operations where the first controller 12 calculates the liquid consumption amount Ic1 may include other operations. Further, one or more of the operations (i) to (iv) described above may be excluded from the non-printing operations where the first controller 12 calculates the liquid consumption amount Ic1. For example, the first controller 12 may calculate the liquid consumption amount Ic1 only for (iv) Ink discharge performed for discharging thickened ink from nozzles when a predetermined period of time elapses after previous printing is completed.

C7. Another Form 7:

In the embodiment described above, the information communication cable 34 is a USB cable. However, the communication between the printing apparatus and the liquid supply apparatus may be performed by another method. For example, the communication between the printing apparatus and the liquid supply apparatus may be performed by an FFC (Flexible Flat Cable). Further, the communication between the printing apparatus and the liquid supply apparatus may be performed by wireless communication such as Bluetooth (registered trademark) or Wi-Fi in compliance with IEEE 802.11 standards.

D. Further Other Forms:

The present disclosure is not limited to the embodiments described above, but can be implemented in various forms without departing from the scope of the disclosure. For example, the present disclosure can be implemented in the forms (aspects) described below. The technical features in the embodiments described above corresponding to the technical features in each form described below can be appropriately replaced and combined in order to solve some or all of the problems of the present disclosure or in order to achieve some or all of the effects of the present disclosure. The technical features can be appropriately deleted if the technical features are not described to be essential in the present specification.

(1) According to one form of the present disclosure, a liquid supply apparatus that can be attached to and detached from a printing apparatus including a first controller that calculates a first liquid consumption amount and a print head that discharges liquid is provided. The liquid supply apparatus includes a liquid storage container that stores the liquid and includes a memory that stores a consumption amount of the stored liquid, a liquid feeding mechanism that feeds out the liquid stored in the liquid storage container to the print head, and a second controller that calculates a second liquid consumption amount. The first liquid consumption amount is a consumption amount of the liquid consumed in a non-printing operation in which the liquid is not discharged from the print head to a recording medium, and the second liquid consumption amount is a consumption amount of the liquid consumed in a printing operation in which the liquid is discharged from the print head to the recording medium. The second controller calculates the second liquid consumption amount based on a liquid feeding amount of the liquid fed out from the liquid feeding mechanism in the printing operation, stores the second liquid consumption amount in the memory, receives the first liquid consumption amount from the first controller, and stores the first liquid consumption amount in the memory.

In such an aspect, information related to the second liquid consumption amount is calculated in the liquid supply apparatus without being transmitted from the printing apparatus to the liquid supply apparatus and is stored in the memory. Therefore, it is possible to reduce communication frequency between the printing apparatus and the liquid supply apparatus as compared with an aspect in which all types of liquid consumption amounts are calculated in the printing apparatus and transmitted to the liquid supply apparatus. As a result, it is possible to reduce the possibility that a printing speed of the printing apparatus is limited by communication between the printing apparatus and the liquid supply apparatus.

(2) The liquid supply apparatus of the form described above may have an aspect where the second controller calculates the liquid feeding amount from a flow rate per unit time of the liquid fed out from the liquid feeding mechanism to the print head and time required for the liquid feeding mechanism to feed out the liquid to the print head in the printing operation.

When employing such an aspect, it is possible to accurately calculate the second liquid consumption amount.

(3) The liquid supply apparatus of the form described above may have an aspect where the liquid feeding mechanism is a pump.

When employing such an aspect, it is possible to accurately control the amount of liquid fed out from the liquid feeding mechanism to the print head. As a result, it is possible to accurately calculate the second liquid consumption amount based on the liquid feeding amount of liquid fed out from the liquid feeding mechanism.

(4) The liquid supply apparatus of the form described above may have an aspect where the second controller calculates the second liquid consumption amount based on the liquid feeding amount obtained from a reduction amount of the liquid which is temporarily stored in the liquid feeding mechanism.

When employing such an aspect, it is possible to accurately calculate the second liquid consumption amount.

(5) The liquid supply apparatus of the form described above may have an aspect where when the liquid storage container is defined as a first liquid storage container, the liquid feeding mechanism includes a second liquid storage container different from the first liquid storage container and a sensor that can detect an amount of the liquid stored in the second liquid storage container.

When employing such an aspect, it is possible to accurately detect the amount of liquid fed out from the liquid feeding mechanism to the print head based on an output of the sensor. As a result, it is possible to accurately calculate the second liquid consumption amount based on the liquid feeding amount of liquid fed out from the liquid feeding mechanism.

(6) The liquid supply apparatus of the form described above may have an aspect where, as the first liquid consumption amount, the first liquid consumption amount includes at least one of a liquid consumption amount by initial filling that fills the printing apparatus with the liquid, a liquid consumption amount by cleaning for solving a discharge failure of the print head, and a liquid consumption amount by inspection for detecting a discharge failure of the print head.

The initial filling, the cleaning, and the inspection of discharge failure continuously consume the liquid. Therefore, it is difficult to accurately calculate a consumption amount of liquid in the liquid supply apparatus. However, in the aspect described above, at least one of the liquid consumption amounts by the initial filling, the cleaning, and the inspection of discharge failure is calculated by the first controller provided in the liquid supply apparatus, where non-printing operations are performed, as a liquid consumption amount consumed in a non-printing operation. Therefore, it is possible to highly accurately calculate the first liquid consumption amount.

(7) The liquid supply apparatus of the form described above may have an aspect where the liquid supply apparatus further includes a USB port that is USB-coupled to the printing apparatus.

When employing such an aspect, the liquid supply apparatus can be coupled to various types of printing apparatuses.

The present disclosure can also be implemented in various forms other than those described above. For example, the present disclosure can be implemented in forms such as a control method of the liquid supply apparatus, a computer program that implements the control method, and a non-temporary recording medium that stores the computer program.

All of a plurality of components included in each form of the present disclosure described above are not necessarily indispensable. Some of the plurality of components can be appropriately changed, deleted, or replaced with other new components, and a part of limited content of these components can be deleted, for solving some or all of the problems described above or achieving some or all of the effects described herein. Further, in order to solve some or all of the problems described above, or to achieve some or all of the effects described herein, it is possible to combine some or all of the technical features included in one form of the present disclosure described above with some or all of the technical features included in other forms of the present disclosure described above and create an independent form of the present disclosure.

What is claimed is:

1. A liquid supply apparatus configured to be attached to and detached from a printing apparatus including a first controller that calculates a first liquid consumption amount and a print head that discharges liquid, the liquid supply apparatus comprising:

a liquid storage container that stores the liquid and includes a memory that stores a consumption amount of the stored liquid;

a liquid feeding mechanism that feeds out the liquid stored in the liquid storage container to the print head; and a second controller that calculates a second liquid consumption amount, wherein the first liquid consumption amount is a consumption amount of the liquid consumed in a non-printing operation in which the liquid is not discharged from the print head to a recording medium, the second liquid consumption amount is a consumption amount of the liquid consumed in a printing operation in which the liquid is discharged from the print head to the recording medium, and the second controller calculates the second liquid consumption amount based on a liquid feeding amount of the liquid fed out from the liquid feeding mechanism in the printing operation and stores the second liquid consumption amount in the memory, and receives the first liquid consumption amount from the first controller and stores the first liquid consumption amount in the memory.

2. The liquid supply apparatus according to claim 1, wherein the second controller calculates the liquid feeding amount from a flow rate per unit time of the liquid fed out from the liquid feeding mechanism to the print head and time required for the liquid feeding mechanism to feed out the liquid to the print head in the printing operation.

3. The liquid supply apparatus according to claim 1, wherein the liquid feeding mechanism is a pump.

4. The liquid supply apparatus according to claim 1, wherein the second controller calculates the second liquid consumption amount based on the liquid feeding amount obtained from a reduction amount of the liquid which is temporarily stored in the liquid feeding mechanism.

5. The liquid supply apparatus according to claim 4, wherein when the liquid storage container is defined as a first liquid storage container, the liquid feeding mechanism includes a second liquid storage container different from the first liquid storage container, and a sensor that can detect an amount of the liquid stored in the second liquid storage container.

6. The liquid supply apparatus according to claim 1, wherein as the first liquid consumption amount, the first liquid consumption amount includes at least one of a liquid consumption amount by initial filling that fills the printing apparatus with the liquid, a liquid consumption amount by cleaning for solving a discharge failure of the print head, and a liquid consumption amount by inspection for detecting a discharge failure of the print head.

7. The liquid supply apparatus according to claim 1, further comprising:

a USB port that is USB-coupled to the printing apparatus.

* * * * *